United States Patent [19]

Brown et al.

[11] 4,262,382

[45] Apr. 21, 1981

[54] MULTI-SPEED BRUSH CONTROL

[75] Inventors: Neil F. Brown, Minneapolis; Keith N. Krier, Tonka Bay; Donald J. Haub, Champlin, all of Minn.; Steven J. Waldhauser, Louiston, N.Y.

[73] Assignee: Tennant Company, Minneapolis, Minn.

[21] Appl. No.: 67,764

[22] Filed: Aug. 20, 1979

[51] Int. Cl.[3] ..... A47L 11/16; A47L 11/202

[52] U.S. Cl. ..... 15/49 R; 15/385; 51/177

[58] Field of Search ..... 15/49 R, 50 R, 87, 320, 15/339, 372, 385, ; 51/177; 318/83, 111, 139

[56] References Cited

U.S. PATENT DOCUMENTS

| | | | |
|---|---|---|---|
| 1,464,031 | 8/1923 | Daly . | |
| 2,202,604 | 5/1940 | Schlapfer | 318/83 |
| 3,204,280 | 9/1965 | Campbell . | |
| 3,280,401 | 10/1966 | Cook et al. | 318/111 X |
| 3,293,678 | 12/1966 | South . | |
| 3,299,460 | 1/1967 | Burgoon | 15/49 R |
| 3,356,173 | 12/1967 | Holcombe | 318/139 X |
| 3,381,335 | 5/1968 | Schaedlich et al. . | |
| 3,646,630 | 3/1972 | Russell . | |
| 3,866,541 | 2/1975 | O'Connor et al. | 15/320 X |
| 3,869,749 | 3/1975 | London et al. . | |
| 3,875,463 | 4/1975 | Reuter et al. . | |
| 4,136,491 | 1/1979 | Redifer | 51/177 |

*Primary Examiner*—Edward L. Roberts

*Attorney, Agent, or Firm*—Merchant, Gould, Smith, Edell, Welter & Schmidt

[57] ABSTRACT

An improvement for floor maintenance equipment employing electrically driven scrubbing or polishing brushes including means for varying the speed of the brush motors. Two brush speeds are provided by switching apparatus which change the interconnection of the brush motors from series to parallel and from parallel to series. This results in a substantial change in motor speed and power.

14 Claims, 3 Drawing Figures

MULTI-SPEED BRUSH CONTROL

TECHNICAL FIELD

The present invention relates to certain improvements in switching and power control circuitry for brushes driven by electric motors mounted on floor maintenance apparatus.

A wide variety of machines are available for use in maintenance of surfaces such as floors, parking lots, and streets. These maintenance machines generally include, among other types of equipment, sweeping machines and scrubbing machines. The present invention may be utilized on any such equipment to vary the speed of the sweeping brushes, scrubbing brushes or other tools. A floor maintenance machine equipped with this invention may be capable of more effective cleaning on a greater variety of floor surfaces than is possible with a single speed brush. The invention may also be coupled with floor maintenance apparatus having a variable speed of travel in order to permit more rapid coverage of the floor area since the brush speed may keep pace with the increased travel speed.

BACKGROUND OF THE INVENTION

Historically, floor maintenance apparatus with electrically powered brushes have had brushes limited to a single speed.

BRIEF SUMMARY OF THE INVENTION

The present apparatus is designed for use in floor maintenance apparatus having electrically driven brushes. Briefly, the floor maintenance apparatus may have a single pole, double throw (SPDT) switch mounted on its control panel. The switch, when operated in one direction, actuates relay coils which close relay contacts thereby arranging the two brush motors in series with each other and with the batteries. Throwing the switch the other direction actuates other relay coils which in effect rearrange the circuitry such that the brush motors are connected in parallel across the batteries. This permits the brush motors to operate at higher voltage and thus have increased power and speed.

DETAILED DESCRIPTION OF THE INVENTION

Figure 1:
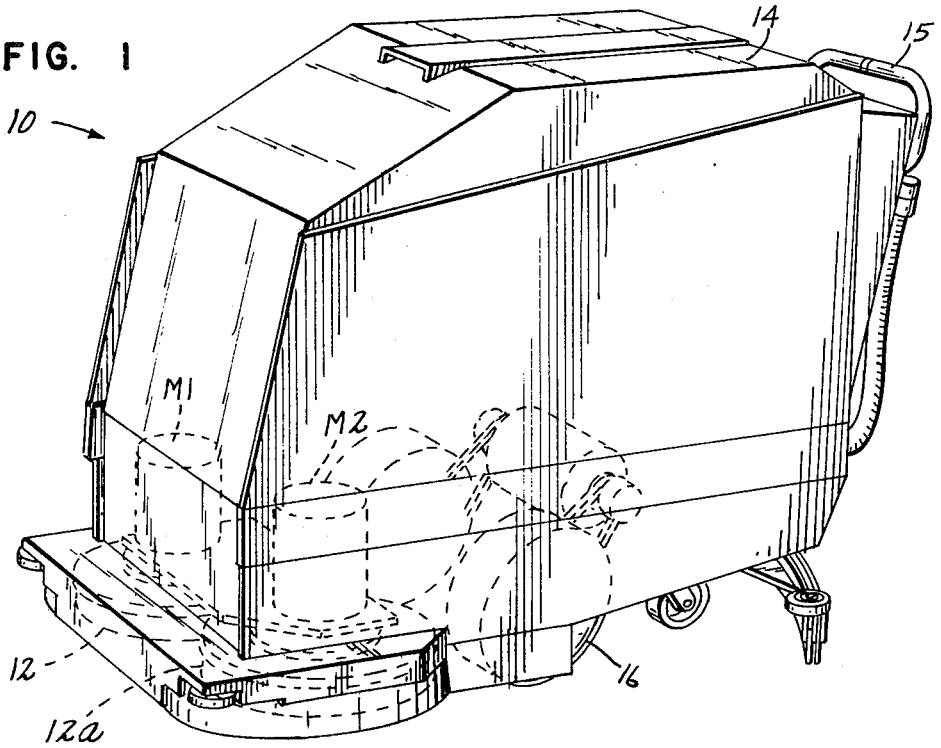
FIG. 1 is a perspective view of a walk behind floor maintenance vehicle with electrically driven brushes.

A walk behind floor maintenance machine 10 of the present invention is disclosed in FIG. 1 having a battery compartment 14, switch controls 15, drive wheels 16 and a pair of brushes 12 and 12*a*.

Figure 2:
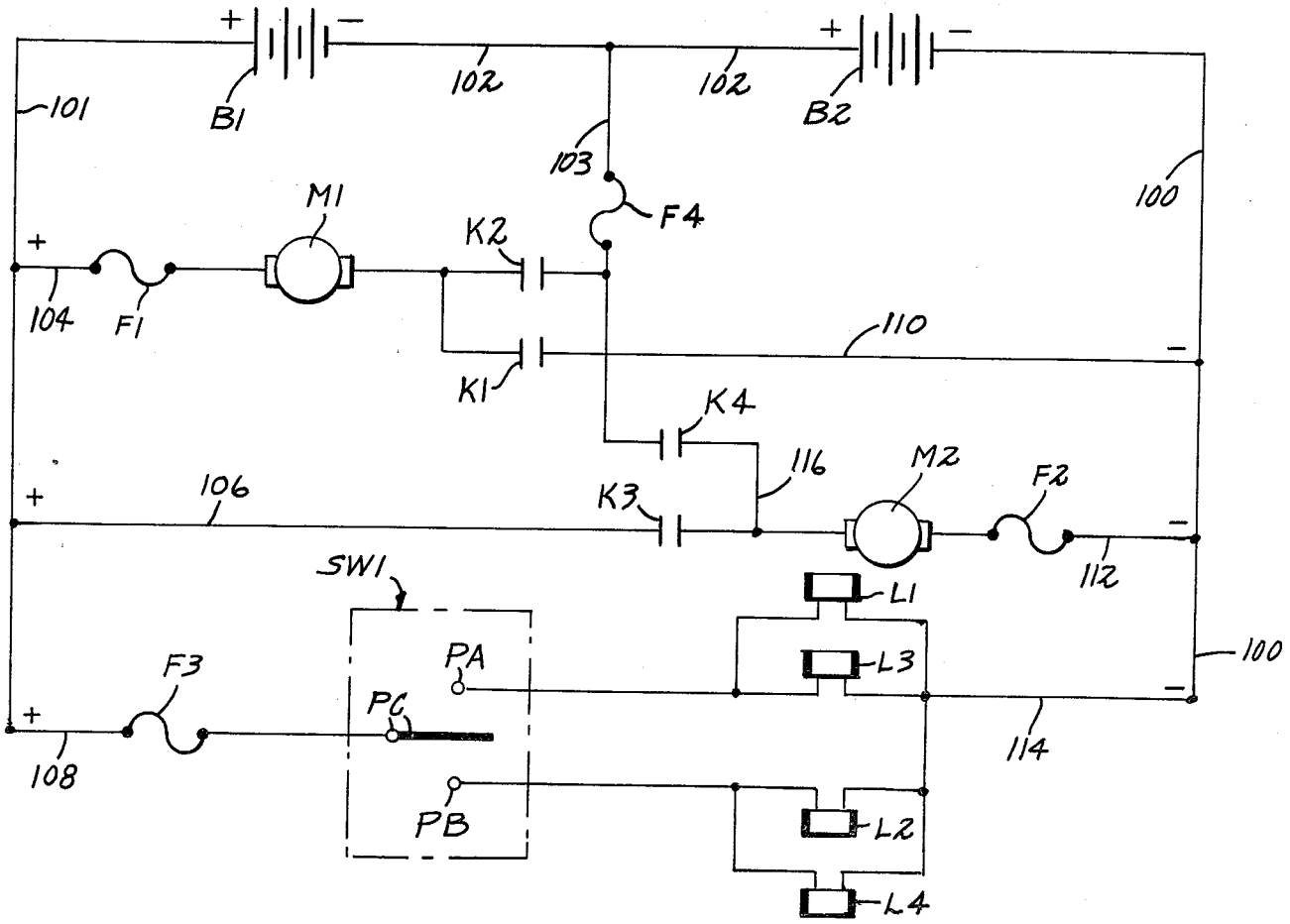
FIG. 2 is a schematic diagram of the present improved control circuitry.

Circuitry for one embodiment of the present improved control circuit is illustrated in FIG. 2 and includes two brush motors M1 and M2, one of which drives each of the brushes 12 and 12*a* shown in FIG. 1 respectively. The motors should be chosen with similar current and power characteristics although identical matching is not necessary. Batteries B1 and B2 may be storage type batteries consisting of several six or twelve volt batteries connected in series. Other voltages, however, are acceptable. For example, battery B1 may be 18 volts and battery B2 may be 18 volts.

Switching is provided for with mechanical relays. Solid state switching devices could of course be employed or switching could be accomplished directly with ganged heavy duty mechanical switches capable of handling the current.

Relay coils L1, L2, L3 and L4 provide mechanical switching for the circuit arrangement of the motors and should be chosen so that they will operate satisfactorily on the voltage of batteries B1 and B2. The relay contacts K1, K2, K3 and K4 associated with the relay coils L1 through L4, respectively, are capable of carrying the current load drawn by motors M1 and M2. These relay contacts are all of the normally-open type.

Switch SW1 consists of a single pole double throw (SPDT) switch with a neutral position for "Off". Switch SW1 may be mechanically connected to switch controls 15 of the vehicle in FIG. 1. It may be desirable to use a slow acting manual switch for SW1 in order to prevent the possibility of a direct short occuring should all relay contacts be closed simultaneously. This could occur if SW1 is operated quickly and the contacts in the newly-completed circuit close before the now-opened circuit contacts have yet to physically open. Fuses F1, F2, F3 and F4 are large enough to handle the current requirements of the circuit in which they are placed yet sufficiently limiting to protect the circuit. Fuse F4 protects wiring against this possible short circuit. Motors M1 and M2 consist of any type of DC motor capable of sufficient power output to rotate the sweeping brushes at appropriate speeds when they are in contact with the floor surface.

CIRCUIT LAYOUT

The circuit in FIG. 2 includes a battery B1 whose positive conductor is connected to bus line 101 and whose negative conductor is connected by bus line 102 to the positive terminal of battery B2. Bus line 102 is also connected to bus line 103. The negative terminal of battery B2 is connected to bus line 100. Bus line 101 is tapped by conductor 108, which is connected to one side of fuse F3. The other side of fuse F3 is connected to the common pole PC of switch SW1. Pole PA of switch SW1 is connected to the parallel combination of relay coils L1 and L3, which is in turn connected to bus line 100 through conductor 114. The other pole PB of switch SW1 is connected to the parallel combination of relay coils L2 and L4 which are connected to bus conductor 100 by conductor 114.

Bus line 101 is tapped by conductor 106 which is connected to one side of relay contact K3. The other side of relay contact K3 is connected to conductor 116 and one side of motor M2. The other side of motor M2 is connected to bus line 100 through fuse F2 and conductor 112. Bus line 101 also is tapped by conductor 104 which is connected to motor M1 through fuse F1. The other side of motor M1 is connected to the parallel combination of relay contacts K1 and K2. The other side of relay contact K1 is connected to bus conductor 100 through conductor 110 and the other side of the relay contact K2 is connected to conductor 103 through fuse F4. Relay contact K4 is connected between conductor 116 to conductor 103.

OPERATION OF THE INVENTION

The improved brush control circuitry may be used in conjunction with a variety of types of floor maintenance equipment including walk behind and riding type floor sweepers. A typical walk behind type vehicle 10 is shown in FIG. 1. Levers 15 in this embodiment may include a speed or direction control lever and a brush speed control lever. The brush speed lever may be connected to switch SW1 such that when the lever is pushed forward switch SW1 is closed from pole PC to PA, hereinafter referred to as the "first position", and when the lever is pulled backward, the circuit is complete from pole PC to PB, hereinafter referred to as the "second position".

When switch SW1 is in the first position, current flows from the batteries through bus line 101, conductor 108, through fuse F3, through switch SW1 and into relay coils L1 and L3. The current then returns to the batteries B1 and B2 through connector 114 and bus line 100. When relay coils L1 and L3 are energized, their corresponding contacts K1 and K3, respectively, are closed. This action completes two independent circuits, one for supplying current to each motor M1 and M2. In the first such circuit current from bus line 101 is tapped at conductor 104 which then travels across fuse F1, through motor M1, across relay contact K1 which is now closed, into conductor 110 and back to the batteries by bus line 100. In the second such circuit bus line 101 is tapped by conductor 106. Current flows into conductor 106, then across relay contact K3, through motor M2, through fuse F2, and into conductor 112, and in turn back to the batteries by bus line 100. This provides the full voltage of batteries B1 and B2 to each motor. Relay coils L2 and L4 are energized when switch SW1 is operated such that the circuit is completed with pole PC to PB. This will close the corresponding relay contacts K2 and K4. Now current will flow from batteries B1 and B2 into bus line 101, through at conductor 104, through fuse F1, into motor M1 through contact K2, through contact K4 into motor M2 and returning to the batteries through the fuse F2, conductor 112 and bus line 100. Conductor 103 carries a current when SW1 is in the second position under some circumstances. If motors M1 and M2 are not electrically identical or if different loads are applied to the brushes when they turn, a current may appear in 103, its direction dependent upon which motor draws more current. In such a case the circuit will appear to have two loops, one with motor M1 and battery B1 and the other with motor M2 and battery B2 with a conductor 103 common to both. The purpose of this configuration is to prevent the unequal operation of the brushes caused by unequal draw of the two motors. Thus motors M1 and M2 are now in series with batteries B1 and B2 and will be receiving approximately half voltage of batteries B1 and B2. It would also be possible to use unequal battery voltages for B1 and B2 or employ a switch to connect conductor 103 to different taps on the cells of the batteries in order to produce unequal speeds in motors M1 and M2.

SECOND PREFERRED EMBODIMENT

Figure 3:
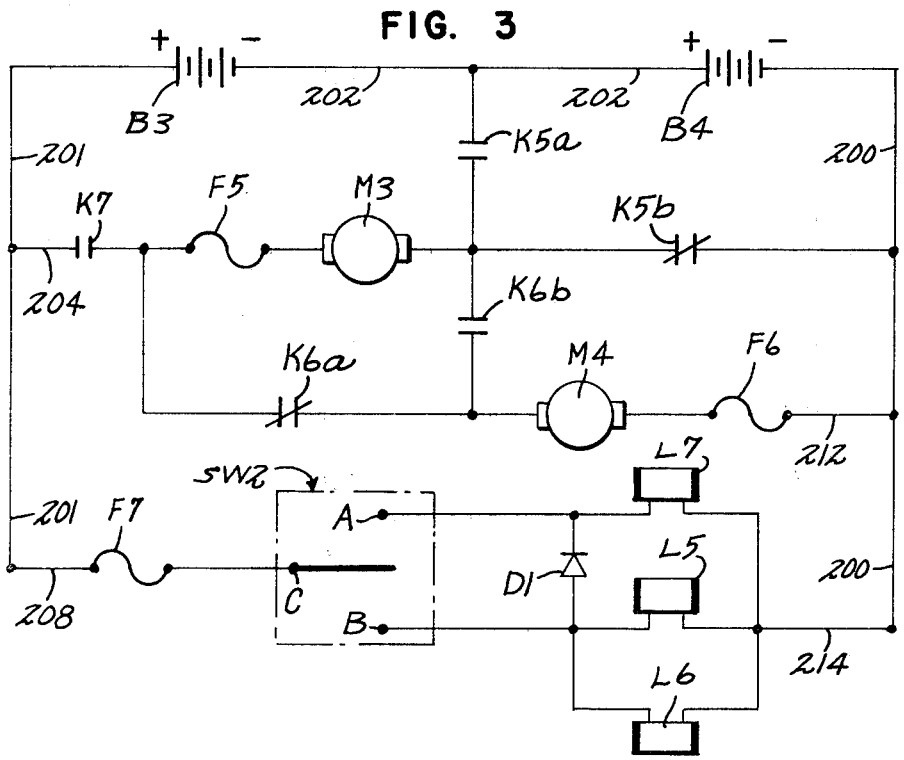
FIG. 3 is a schematic diagram of a second preferred embodiment of the improved control circuitry.

A second preferred embodiment of this invention is shown in FIG. 3 of the drawings. This alternative circuitry provides the same results as that of FIG. 2 with the advantage that there is no possibility of a direct short which could occur in the circuitry in FIG. 2 if all relay contacts happen to be closed at the same moment. This potential problem was described in the Detailed Description of the Invention supra.

This second preferred embodiment contains a power supply consisting of batteries B3 and B4, two brush motors M3 and M4, three relay coils L5–L7 with corresponding relay contacts K5*a*, K5*b*, K6*a*, K6*b* and K7 respectively, a single-pole-double-throw manual switch SW2 with a neutral position for "Off", three fuses F5, F6 and F7, and a diode D1. Relay coil L5 has corresponding relay contacts K5*a* which is normally open and K5*b* which is normally closed. Relay coil L6 has corresponding relay contacts K6*a* which is normally closed and K6*b* which is normally open. Relay coil L7 has a corresponding relay contact K7.

The above-mentioned components are connected as follows: the positive terminal of battery B3 is connected to the bus line 201 and its negative terminal is connected to the positive terminal of battery B4 via conductor 202. The negative terminal of battery B4 is connected to bus line 200. Bus line 201 is tapped by conductors 204 and 208. Conductor 204 is connected to one side of relay contact K7, the other side of K7 being connected to one side of fuse F5 and one side of relay contact K6*a*. The other side of fuse F5 is connected to one side of motor M3, the other side of M3 being connected to one side of relay contacts K5*a*, K5*b* and K6*b*. The other side of relay contact K5*a* is connected to conductor 202, the other side of contact K5*b* is connected to bus line 200, the other side of K6*b* is connected to the other side of K6*a* and one side of motor M4. The remaining side of M4 is connected to fuse F6 which in turn is connected to bus line 200 by conductor 212. Conductor 208 is connected to one side of fuse F7. The other side of fuse F7 is connected to the common pole C of switch SW2. One pole of SW2 denoted A is connected to the cathode side of diode D1 and one side of relay coil L7. The remaining pole of SW2 denoted B is connected to the anode side of diode D1 and one side of relay coils L5 and L6. Note that normally-open contacts of either L5 or L6 could be substituted for D1 and work as described without potential reversed polarity problems with D1. The remaining sides of relay coils L5, L6 and L7 are connected in parallel and in turn to bus line 200 by conductor 214.

This second preferred embodiment operates as follows: when switch SW2 is closed from pole C to pole A the current flows from battery B3 into bus line 201 and conductor 208 through fuse F7 across switch SW2 through relay coil L7 and back to the battery via conductor 214 and bus line 200. With this circuit complete L7 is energized and relay contact K7 is now closed. Current may now also flow from bus line 201 through relay contact K7 and contact K6*a* which is normally closed through motor M4, fuse F6 and back to the battery through conductor 212 and bus line 200. Current will also flow from relay contact K7 through fuse F5, motor M3 and normally-closed relay contact K5*b* into bus line 200 and back to the batteries. Thus, in this configuration motors M3 and M4 are essentially in parallel with each other and in series with batteries B3 and B4.

With switch SW2 closed from pole C to pole B, all three relay coils L5, L6 and L7 would be energized. Notice that L7 is energized with current supplied through diode D1. With all three coils energized all relay contacts would be operated. Thus, current would flow from bus line 201 across relay contact K7 and fuse F5 through motor M3 into relay contact K6*b*, through motor M4 and fuse F6 and returning to battery B4 through conductor 212 and bus line 200. Notice that the motors M3 and M4 are now connected in series with each other and with batteries B3 and B4.

Should the current requirement of one of the two motors be unequal as a result of unequal specifications of the motors or unequal force applied to the armatures, current may flow across relay contact K5*a*. The direction of this current is dependent upon which motor is drawing the greater current. The purpose of this relay contact is analogous with that of conductor 103 of FIG. 2. With such a conductor in place neither motor M3 or M4 will be stalled by unequal current requirements when the motors are in series.

What we claim is:

1. Floor maintenance equipment including a plurality of rotary means for maintaining floor surfaces, said rotary means being driven by at least a pair of electric motors and means for varying the speed of said, electric motors, said speed varying means including electric circuitry for switching the voltage level applied to said electric motor means by selectively changing the electrical relationship between said motors from series to parallel and from parallel to series.

2. The equipment of claim 1 wherein said motors comprise at least two DC motors.

3. Floor maintenance equipment comprising a body, a plurality of wheels for supporting said body, power means for driving said wheels, means for steering said equipment, at least one pair of rotating brushes for acting on a floor surface, at least one pair of electric motors for driving said brushes, power means for supplying electric current to said motors, and circuit means for connecting said motors to said power means selectively in parallel or in series for varying the speed of said motors.

4. The equipment of claim 3 wherein said circuit means include switching means for changing the voltage applied to said motor means.

5. The equipment of claim 4 wherein said switching means includes a plurality of relays.

6. The equipment of claim 5 wherein said relays include a first and second pair of relays and wherein said power means includes a first and second power means.

7. The equipment of claim 6 wherein said switching means includes a switch having a first and second position, said first position operating said first pair of relays which connect said motors in parallel with each other, said second position operating said second pair of relays which connect said motors in series with each other.

8. Floor maintenance equipment comprising a body, a plurality of wheels for supporting said body, means for steering said equipment, first and second rotary cleaning and maintaining means for maintaining floor surfaces, first and second motor means for powering said first and second cleaning means respectively, drive means for driving said wheels, first and second electrical power sources, and switching means for connecting said first and second motor means to said first and second power sources selectively in series or in parallel.

9. The equipment of claim 8 wherein said switching means includes a switch having a first and second position, a first pair of relays operated by said switch in said first position, a first circuit which connects said first and second motor means in parallel with each other and in series with the series combination of said first and said second power source, said first pair of relays serving to activate said first circuit, a second pair of relays operated by said switch in said second position, a second circuit which connects said first motor means to said first power source and a third circuit which connects said second motor means to said second power source and wherein said second and third circuits include common conductor means which is shared by both said second and third circuits, said second pair of relays serving to activate said second and third circuits.

10. The equipment of claim 9 wherein said first pair of relays includes first and second relay contacts which connect said first and second motor means in series with said series combination of said first and second power sources and wherein said second pair of relays includes third and fourth relay contacts which connect said second and third circuits respectively.

11. Floor maintenance equipment including a plurality of rotary means for maintaining floor surfaces, said rotary means being driven by electric motor means including at least two DC motors, and means for varying the speed of said rotary means, said speed varying means including means adapted to selectively change the circuit operating said motors from series to parallel and from parallel to series.

12. Floor maintenance equipment comprising a body, a plurality of wheels for supporting said body, power means for driving said wheels, means for steering said equipment, first and second rotary cleaning means for maintaining floor surfaces, first and second motor means for powering said first and second cleaning means respectively, first and second power sources, said first and second power motor means being electrically connected to said first and second power sources, switching means for interconnecting said first and second motor means and said first and second power sources selectively in parallel or in series, said switching means including a switch having a first and second position, a first pair of relays operated by said switch in said first position, a first circuit which connects said first and second motor means while in parallel with each other to the series combination of said first and second power source, said first pair of relays serving to activate and deactivate said first circuit, a second pair of relays operated by said switch in said second position, a second circuit which connects said first motor means to said first power source and a third circuit which connects said second motor means to said second power source and wherein said second and third circuits include common conductor means which are shared by both said second and third circuits, said second pair of relays serving to activate and deactivate said second and third circuits.

13. Floor maintenance equipment including a plurality of rotary means for maintaining floor surfaces, said rotary means being operatively driven by at least two electric motors, and means for varying the speed of said rotary means, said speed varying means including switching means adapted for selectively changing the electrical relationship between said motors from series to parallel and from parallel to series.

14. Floor maintenance equipment comprising a body, a plurality of wheels for supporting said body, drive means for driving said wheels, means for steering said equipment, first and second rotary means for maintaining floor surfaces, first and second motor means powering said first and second rotary means respectively, first and second electrical power sources, and switching means for connecting said first and second motor means between a first electrical configuration connecting said motor means in series with each other and a second electrical configuration connecting said motor means in parallel with each other, so that said rotary means may be selectively operated at different speeds and power levels.

* * * * *